364-422 SR
FTH11 XR 4,362,054

United States Patent [19]
Ringot

[11] 4,362,054
[45] Dec. 7, 1982

[54] METHOD AND APPARATUS FOR DETERMINING DIRECTION PARAMETERS OF A CONTINUOUSLY EXPLORED BOREHOLE

[75] Inventor: Jean Ringot, Gif sur Yvette, France

[73] Assignee: Schlumberger Technology Corp., New York, N.Y.

[21] Appl. No.: 189,421

[22] Filed: Sep. 22, 1980

[30] Foreign Application Priority Data

Sep. 27, 1979 [FR] France ..... 7924029

[51] Int. Cl.³ ..... E21B 47/00
[52] U.S. Cl. ..... 73/152
[58] Field of Search ..... 73/151, 152; 33/304, 33/313

[56] References Cited

U.S. PATENT DOCUMENTS 3,862,499 1/1975 Isham et al. ..... 33/312
3,899,834 8/1975 Harrison, Jr. ..... 33/352
3,935,642 2/1976 Russell ..... 33/302
4,016,766 4/1977 Morris ..... 73/517 R
4,227,405 10/1980 West ..... 33/313 X

*Primary Examiner*—Jerry W. Myracle
*Attorney, Agent, or Firm*—David H. Carroll

[57] ABSTRACT

Method and apparatus for continuously determining direction parameters of a borehole from the position of a well logging tool in the borehole during tool movement in the borehole, comprise a well logging tool including an accelerometer and a direction indicator, such as a magnetometer, with three sensitive axes respectively. Output signals derived from the accelerometer are prefiltered and then combined with respective output signals derived from the direction indicator in a manner so as to reduce to negligible proportions the effects of tool motion on respective ones of the output signals. The resulting signal is then subjected to a selective low-pass filtering, and the components thereof are thereafter, respectively combined with corresponding, suitable components of the original output signals in a manner such as to derive direction parameters for the borehole.

22 Claims, 6 Drawing Figures

MT1
N3
D2
N4
DEV2
AZIM3
Sin I
RB.3
AZI1.2
AZIN2
AZI1.1
COMP1
DEV1
RB2
AFF

METHOD AND APPARATUS FOR DETERMINING DIRECTION PARAMETERS OF A CONTINUOUSLY EXPLORED BOREHOLE

This invention relates to a method and apparatus for continuously determining direction parameters of a borehole as a function of borehole depth, and more particularly relates to a method and apparatus comprising a well logging tool including means for producing an acceleration signal detected along three reference axes and means for producing a direction indication or a reference signal. The tool further includes means for processing and combining the acceleration signal and the reference signal in a manner such as to derive direction parameters of a borehole through which the tool is travelling which parameters are free from the effects of tool motion.

The earth's crust is made up of formation layers of various types of materials, thicknesses and inclinations and information concerning the successive layers and their inclination as they intersect a borehole is of great value in undertaking a search for petroleum deposits. It will be appreciated that this information, representative of the relative orientation of the formation layers and the borehole, is insufficient in determining a three-dimensional topographic orientation of the formation layers in the absence of additional information regarding the position of the tool in the borehole relative to a three-dimensional topographic orientation.

Heretofor, three dimensional topographic orientations have been determined, in the aviation field, through means including an accelerometer and a magnetometer. Signals derived from these two instruments were readily combined since the smooth trajectory of an airplane flying at constant speed is instrumental in reducing the effects of the airplane's motion on the output of the accelerometer. Of course, while the airplane is undergoing sudden accelerations the output of the accelerometer is generally not useful in determining a three dimensional topographic orientation of the airplane.

In U.S. Pat. No. 3,862,499 to Isham et al, a well logging tool is shown to include an accelerometer and a magnetometer. The tool is subject to being lowered into a borehole and stabilized at a certain depth and signals from the accelerometer and from the magnetometer are derived. These signals are thereafter combined to obtain direction parameters of the tool in the borehole, namely the deviation angle defined as the angle between the longitudinal axis of the borehole and the vertical, and the azimuth defined as the angle between two vertical planes one of which contains the longitudinal axis of the borehole and the other the direction of magnetic north. Thereafter, the sonde is moved within the borehole and stabilized at another depth and signals from the accelerometer and the magnetometer are derived and combined to obtain values of the deviation angle and of the azimuth for that depth.

It will be appreciated that the above-described technique of Isham et al, while providing information regarding tool orientation in a bore-hole does not provide such information in a continuous manner, i.e., during tool movement in the borehole. Stabilizing the tool at each point of measurement, as required by that disclosure, is a time consuming process which unnecessarily limits the number of times, and therefore the number of points along the borehole, at which such measurements can be taken. This means that the position of the well logging tool in relatively large portions of a borehole can only be extrapolated from information derived at the nearest points at which such measurements were undertaken. It will be therefore appreciated that the above-described tecnhique is unsatisfactory for deriving reliable information regarding the position of a well logging tool in a borehole for a continuous length of the borehole and during tool movement through that length of the borehole.

In accordance with principles of the present invention method and apparatus are provided for continuously determining the position of a well logging tool in a borehole during tool movement in the borehole. The method and apparatus comprise a well logging tool including an accelerometer and a direction indicator, such as a magnetometer, with three sensitive axes respectively. Output signals derived from the accelerometer are prefiltered and then combined with respective output signals derived from the direction indicator in a manner so as to reduce the effects of tool motion on the accelerometer output signals. The resulting signal is then subjected to a selective low-pass filtering, and is thereafter, respectively combined with the output signals of the direction indicator in a manner such as to derive direction parameters for the borehole.

In accordance with further principles of the present invention, the measurement of acceleration and reference signals are continuously undertaken during tool movement and the combining of the signals is undertaken in a manner such that the acceleration effects attributable to tool motion and specifically rotational motion can be effectively reduced from the accelerometer output signals.

In accordance with one embodiment of the present invention a well logging tool comprises an accelerometer and a direction indicator, each having first and second sensitive axis perpendicular to each other and to the longitudinal axis of the tool, and a third sensitive axis having a longitudinal direction coinciding with the axis of the tool. The respective outputs of the accelerometer and the direction indicator include signals each comprising two transverse axial components and one longitudinal axial component. The direction indicator may, for example, be a magnetometer providing a reference signal such as the direction of the vector of the earth's magnetic field. Initially, a transverse diagonal component of the reference signal is determined from the transverse axial components of that signal. From this transverse diagonal component and from the longitudinal axial component of this same reference signal the sign of the difference between a first angle formed between a fixed direction vector and the longitudinal axis of the tool and a limit angle of a predetermined value is found. The stabilizing signals and the signals to be stabilized are defined respectively as the reference and acceleration signals when the sign of the difference is positive and in the opposite order when this sign is negative. A transverse diagonal component of the stabilizing signal may then be determined from its transverse axial components when the acceleration signal is the stabilizing signal. The combination of the components of the signals, in a final stage, involves the combination of filtered and normed transverse diagonal and longitudinal axial components of the acceleration signal to determine a first parameter representing the angle formed between the vertical and the longitudinal axis of the tool. Another direction parameter is determined through the combination of three normalized and stabilized axial components of the signal to be stabilized, and the normalized longitudinal and transverse diagonal components of the stabilizing signal. This another parameter represents the angle formed between the horizontal trace of the vertical plane going through the longitudinal axis of the tool and the horizontal projection of the vector having a fixed direction different from the vertical.

In further accordance with principles of the present invention, the final stage in the combination of the components of the signals advantageously comprises an operation for determining a third direction parameter. This operation involves the combination of the three nonstabilized axial components of the acceleration signal and three nonstabilized axial components of the reference signal, so as to represent the angle formed between the horizontal projection of the vector of fixed direction which is different from the vertical and the horizontal projection of a vector perpendicular to the longitudinal axis of the tool and joining this axis to a fixed point on the tool. In addition, a fourth direction parameter can be determined through an operation involving the combination of the two nonstabilized transverse axial components of the acceleration signal. This fourth parameter represents the dihedral angle formed between a vertical plane containing the longitudinal axis of the tool and a plane containing the axis of the tool and going through the fixed point of the tool. Under current well exploration conditions, it is advantageous that a low-pass filtering operation eliminate, by an attenuation increasing rapidly from 3 dB, the signal variations showing a frequency higher than $8\times10^{-2}$ Hz and that a prefiltering of signals consist in an attenuation, increasing from 3 dB, in the signal variations exhibiting a frequency higher than 2.5 Hz.

Figure 1:
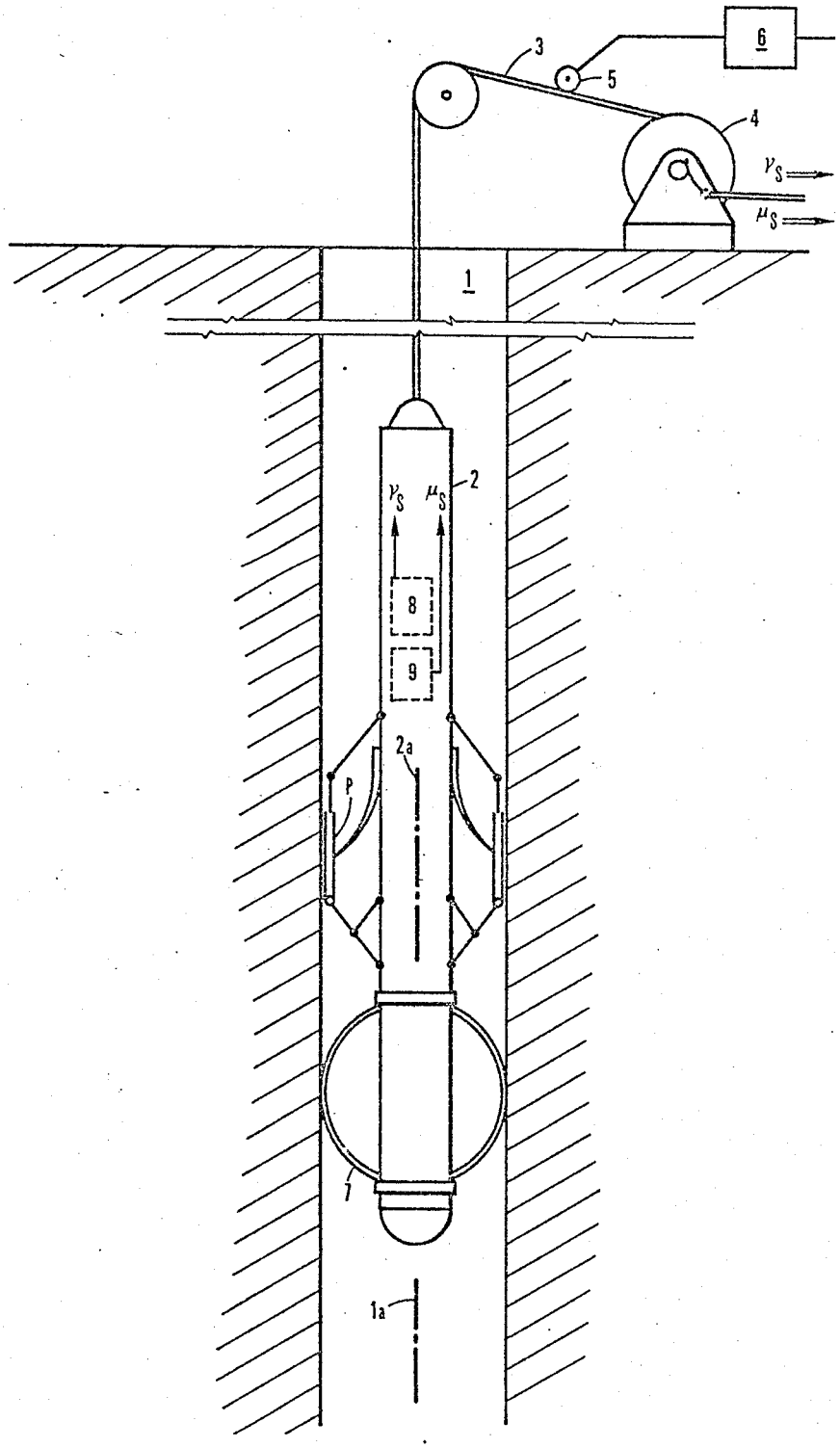
FIG. 1 is a schematic view representing, in section, an apparatus in accordance with the present invention.
Figure 3A:
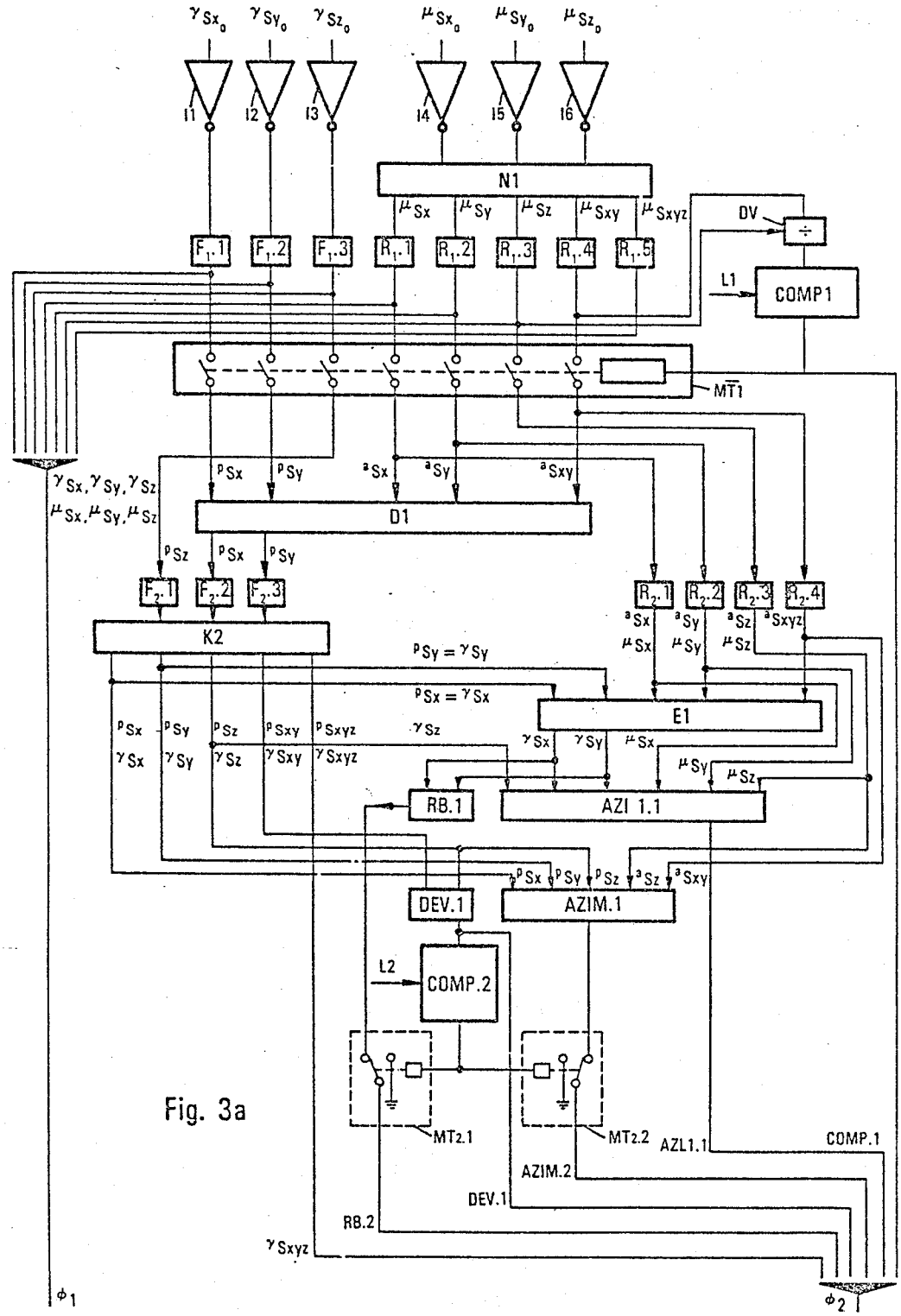
Figure 3B:
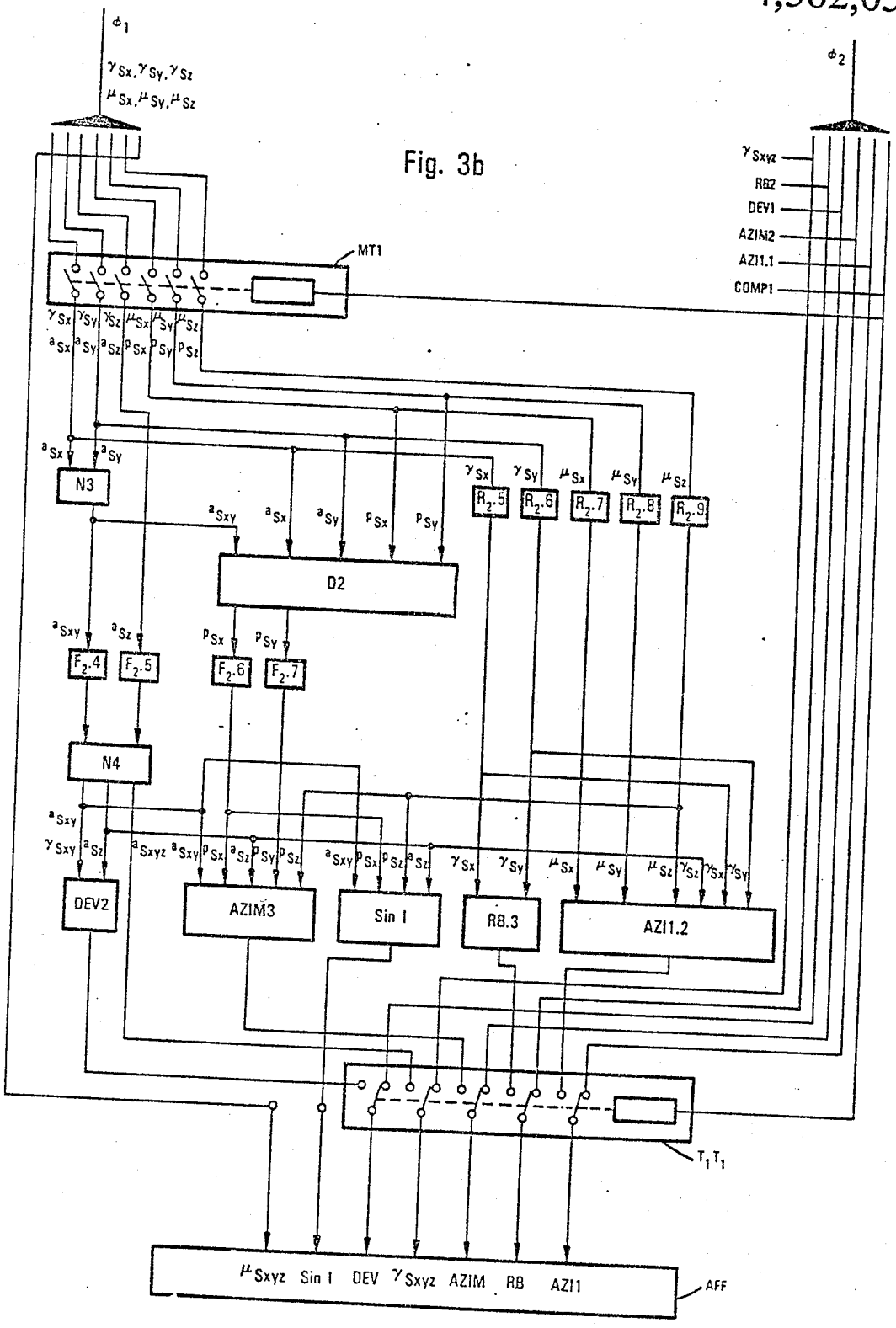
Figure 4:
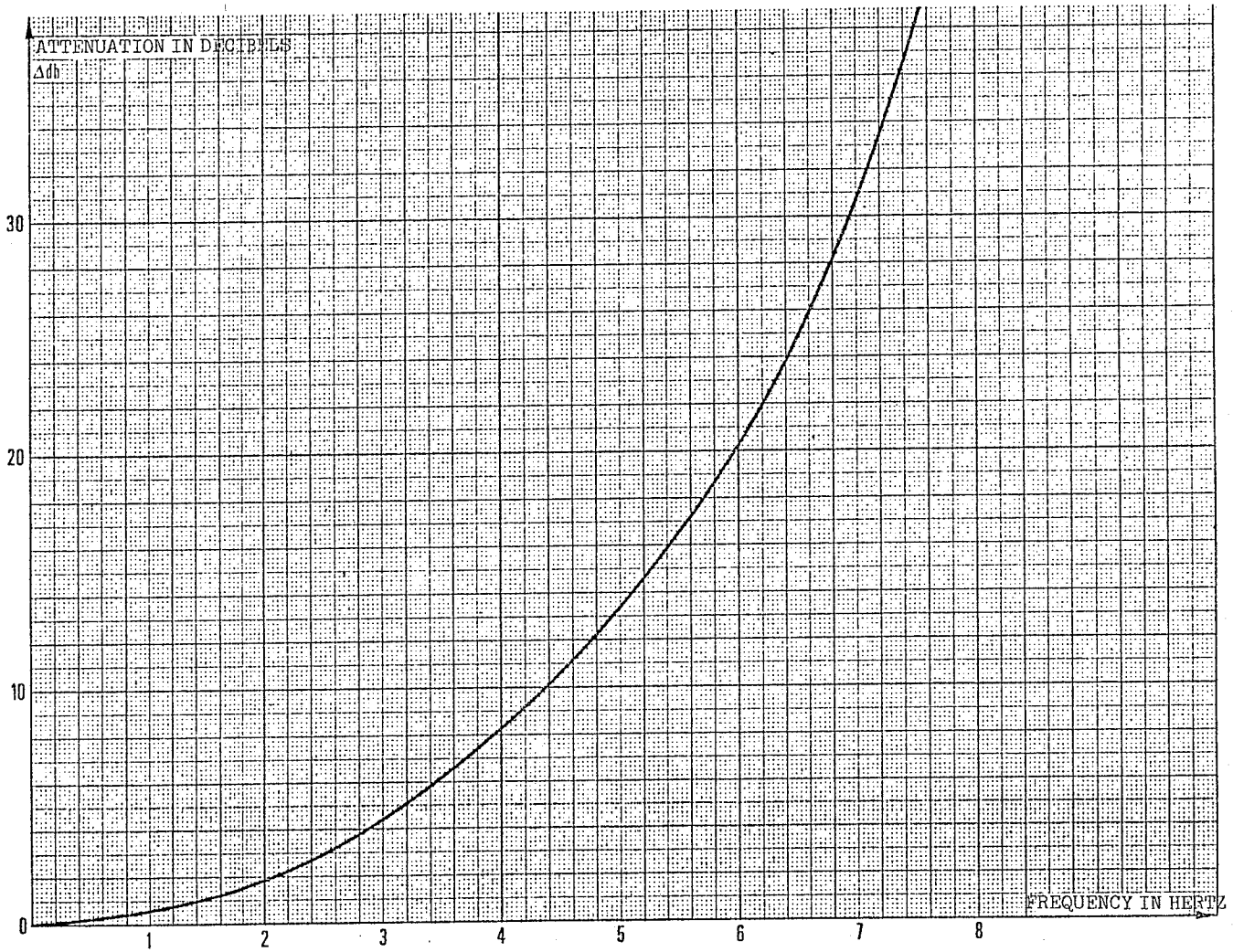
Figure 5:
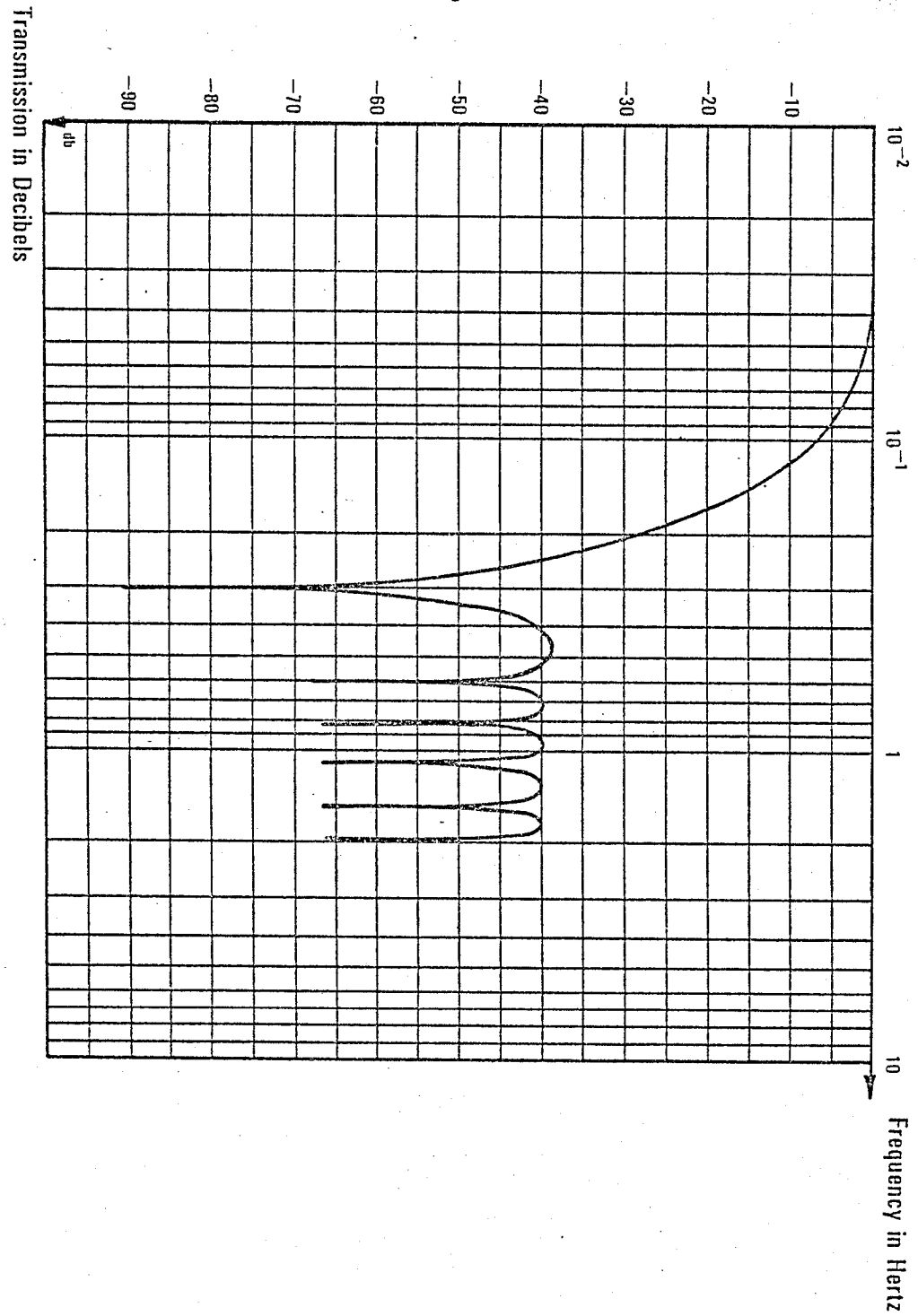

FIGS. 3*a* and 3*b* are schematic representations of circuits for processing components of acceleration and reference signals forming part of the apparatus of FIG. 1;

FIG. 4 is a diagram representing characteristics of a filter useful in the practice of the present invention; and FIG. 5 is a diagram representing characteristics of a low-pass filter useful in the practice of the present invention.

With reference to FIG. 1, a borehole 1 is shown intersecting earth formations. An elongated well logging tool 2 is shown suspended in the borehole 1 by means of a cable 3 connected to a winch 4. Between the winch 4 and the top edge of the borehole, the cable 3 runs over a measurement wheel 5 connected to a counter 6 for recording the rotations of the wheel 5. The depth at which the tool is located in the well is deduced from the indication of the counter 6.

The tool 2 includes centering bows 7 which enable the tool to adapt in the borehole to a position where the longitudinal axis 2*a* of the tool coincides, at least over the length of the tool, substantially with the longitudinal axis 1*a* of the borehole.

The tool 2 comprises an accelerometer 8 and a magnetometer 9 which are firmly secured to the tool. The accelerometer 8 delivers a signal having three axial components whose amplitudes represent the lengths of projections, on three respective axes, of a vector associated with all the accelerations undergone by the tool. The magnetometer 9 delivers a signal having three axial components whose amplitudes represent the lengths of projections, on three respective axes, of a vector associated with the magnetic field going through the tool, i.e. in practice the earth's magnetic field.

It will be appreciated that the magnetometer 9 can be replaced by any other direction indicator such as a gyroscope delivering a signal having three components which indicate information regarding tool locations in relation to a characteristic direction, advantageously other than vertical, of the gyroscope.

In practice of the present invention, the tool 2 is lowered into the borehole 1 to a known depth, and is raised by means of the winch and the cable at a substantially constant speed while the accelerometer 8 and magnetometer 9 produce their respective signals which are transmitted to the surface via the cable 3 and recovered on the surface in correlation with the signal from the counter 6.

Owing in particular to the irregularities of the wall of the borehole and the elasticity of the cable 3, the tool 2 is subjected to accelerations which, in addition to the acceleration of gravity, include accelerations due to the movement of the tool 2 in the borehole. The tool 2 usually undergoes transverse movements and shocks against the wall of the borehole 1 and in addition, despite the fact that the cable is rewound at a substantially constant speed, the tool 2 advances in the longitudinal direction of the borehole in progressive jerks in a "yo-yo" like movement. Further, the tool generally undergoes an additional rotational movement around its longitudinal axis.

It is possible to regard the components of the reference signal derived from the magnetometer as substantially independent of the sudden movements of the tool, while regarding the components of the acceleration signal, derived from the accelerometer, as being representative of such movements.

Therefore, in determining the position of the tool 2 in the borehole 1, which may also be expressed as direction parameter of the borehole, from the output signals of the accelerometer 8 and the magnetometer 9 in accordance with the present invention, different signal processing stages and operations have to be performed. Preferably, such processing can be expedited with the aid of a digital computer.

In the description given below of these signal processing stages and operations, the following definitions will be used:

S designates a signal of a vectorial nature with axial components $S_x$, $S_y$ and $S_z$;

$S_{xy}$ designates the partial norm or diagonal component of this signal: $S_{xy}=\sqrt{S_x^2+S_y^2}$;

$S_{xyz}$ designates the norm: $S_{xyz}=\sqrt{S_x^2+S_y^2+S_z^2}$ of the signal S;

$S_{\xi o}$ and $S_\xi$ designate the same axial component of the signal S, respectively before and after an operation modifying this component; $\xi_o$ and $\xi$ can respectively adopt the following significations: $x_o$ and x; $y_o$ and y; $z_o$ and z; $x_oy_o$ and xy;

$S_\xi$ designates a normalized component if $S_\xi=(S_{\xi o}/S_{x_oy_oz_o})$ $^\gamma S$ and $^\mu S$ designate respectively the acceleration and reference signals of a vectorial nature, respectively coming from accelerometer 8 and the magnetometer 9 and having respective axial components $^{\gamma}S_x$, $^{\gamma}S_y$, $^{\gamma}S_z$ and $^{\mu}S_x$, $^{\mu}S_y$ and $^{\mu}S_z$;

$^{a}S$ and $^{p}S$ (a=active; p=passive) designate respectively a stabilizing signal and a signal to be stabilized, the nature of the stabilization being explained in detail later on.

Figure 2:
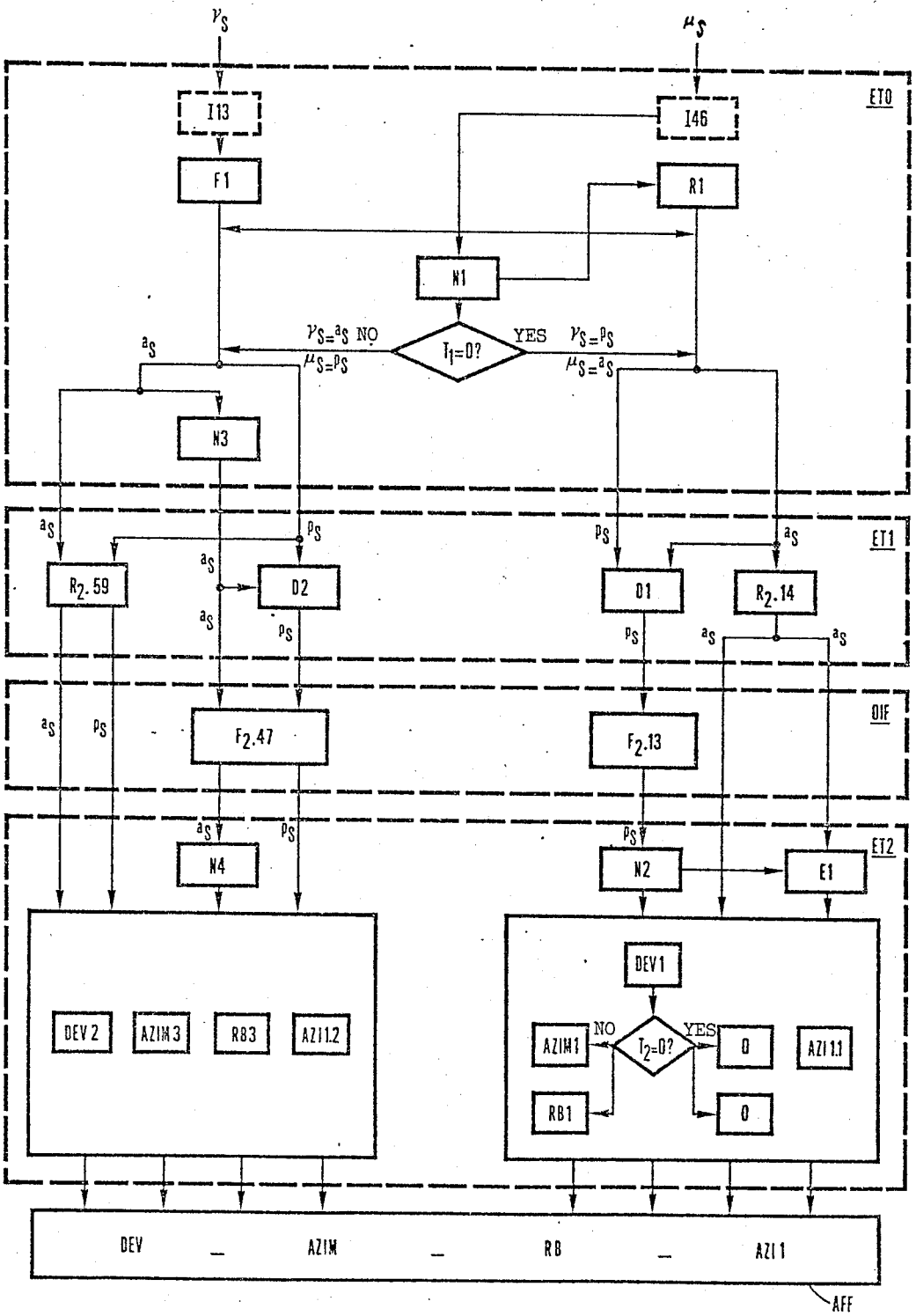
FIG. 2 is a functional diagram (flow-chart) representing the main operations of the apparatus of FIG. 1.

Referring now to FIG. 2 which represents phases in a signal processing apparatus for use in the present invention for the determination of values of borehole direction parameters, the following is shown. A preliminary stage ET0, a virtual stabilization stage ET1, including an operation $D_1$ or $D_2$ for eliminating the rotation effect, and a final stage ET2 for the combination of the processed components of the signals $^{\gamma}S$ and $^{\mu}S$. The stage ET1 and the final stage ET2 are separated by an intermediate operation OIF with low-pass filtering $F_2$ 13 or $F_2$ 47.

The preliminary stage ET0 includes, in addition to operations I 13 and I 46 for inverting the sign of the components of signals $^{\gamma}S$ and $^{\mu}S$, operations for prefiltering $F_1$ of signal $^{\gamma}S$, for delay $R_1$ of signal $^{\mu}S$, for normalizing $N_1$ of signal $^{\mu}S$, and for selection with test "$T_1=0$?" and, possibly, for normalizing $N_3$ of signal $^{\gamma}S$.

Operations I 13 and I 46 consist in changing the sign of the components of signals $^{\gamma}S$ and $^{\mu}S$ and are necessary only when the stage ET0 covers the signals directly delivered by the accelerometer 8 and the magnetometer 9 as representative of vectors of opposite direction to those of the acceleration vector on the one hand and the earth's magnetic field vector on the other hand.

The prefiltering and delay operations $F_1$ and $R_1$ respectively will be explained in detail later.

In addition to obtaining prefiltered components of the acceleration signals, the preliminary stage ET0 has two basic purposes. The components of the acceleration and reference signals generally carry information related to spurious phenomenon, namely the rotation of the tool around its axis. To eliminate the effects of this rotation on the values of the transverse axial components of one of the signals, hereinafter called the "signal to be stabilized", one makes use, in accordance with the present invention, in the subsequent virtual stabilization stage ET1, of transverse axial components and of a transverse component, called the diagonal, of the other signal, hereinafter called the "stabilizing signal". And, depending on the topographic orientation of the longitudinal axis of the tool, it may be preferable to either use the components of the signals from the magnetometer to correct the components of the signal from the accelerometer or, conversely, use the components of the signal from the accelerometer to correct the components of the signal from the magnetometer. The preliminary stage ET0 thus has the particular function of making determinations as to which of the two signals $^{\gamma}S$ and $^{\mu}S$ should be the signal to be stabilized $^{p}S_2$, and providing to the virtual stabilization signal ET1, the diagonal transverse component of the stabilizing signal, i.e., $^{a}S_{xy}$ according to the notation previously introduced.

The operation for determining $^{a}S_{xy}$ is included in the block $N_3$ or in the block $N_1$ depending, respectively, on whether the role of $^{a}S$ is played by the signal $^{\gamma}S$ or by the signal $^{\mu}S$. But, since the selection with test "$T_1=0$ ?" presupposes, as it will appear below, the use of the diagonal component of one of the two signals, and quite preferably of $^{\mu}S$. One first determines $^{\mu}S_{xy}$ during the operation $N_1$; one then uses $S_{xy}$ to carry out the test "$T_1=0$ ?" which makes it possible to decide which of the two signals is to play the role of stabilizing signal $^{a}S$. One would determine $^{a}S_{xy}=^{\gamma}S_{xy}$ during the operation $N_3$ if the test "$T_1=0$ ?" has led to the assignment to $^{\gamma}S$ the role of stabilizing signal $^{a}S$.

The detailed description of the different operations of the entire parameter determination phase makes reference generally, below, to FIGS. 3*a* and 3*b* which represent process steps relating to single components or signal norms.

Blocks I 13, I 46; $F_1$; $R_1$,$R_2$.14, $R_2$.59; $F_2$.13 and $F_2$.47 of FIG. 2 respectively represent inverters $I_1$ to $I_3$ and $I_4$ to $I_6$, the prefiltering filters $F_1$.1 to $F_1$.3, the buffer cells $R_1$.1 to $R_1$.5, $R_2$.1 to $R_2$.4 and $R_2$.5 to $R_2$.9 and the filters $F_2$.1 to $F_2$.3 and $F_2$.4 to $F_2$.7 of FIGS. 3*a* and 3*b*.

Blocs $N_1$ to $N_4$, $D_1$ and $D_2$, $E_1$; DEV 1, DEV 2, RB 1 and RB 3, AZI1.1 and AZI1.2, AZIM1 and AZIM3 can be regarded, for ease of illustrations, as operation steps in FIG. 2, and as function generators capable of performing these operation steps, in FIGS. 3*a* and 3*b*.

The accelerometer and magnetometer output axial components $^{\gamma}S_{xo}$, $^{\gamma}S_{yo}$, $^{\gamma}S_{zo}$ and $^{\mu}S_{xo}$, $^{\mu}S_{yo}$ and $^{\mu}S_{zo}$ are available at the beginning of parameter value determining phase and can be considered to have a constant amplitude over each basic time interval. $\Delta t$.

The axial components of the magnetometer, with a sign possibly corrected by the inverters $I_4$, $I_5$ and $I_6$ are applied to the function generator $N_1$ which delivers at its output the norm $^{\mu}S_{xyz}$, the normal axial components $^{\mu}S_x=^{\mu}S_{xo}/^{\mu}S_{xyz}$, $^{\mu}S_y=^{\mu}S_{yo}/^{\mu}S_{xyz}$, $^{\mu}S_z=^{\mu}S_{zo}/^{\mu}S_{xyz}$ and the normalized transverse signal component $$^{\mu}S_{xy} = \sqrt{(^{\mu}S_{xo})^2 + (^{\mu}S_{yo})^2/^{\mu}S_{xyz}}.$$

The axial components of the accelerometer, with sign possibly corrected by the inverters $I_1$, $I_2$ and $I_3$ are applied to the identical prefiltering filters $F_1$.1 to $F_1$.3.

If $\xi_o$ represents $x_o$, $y_o$ or $z_o$ for a component before filtering, if $\xi$ represents x, y, z for a component after filtering, if k and l represent integers and if $^{\gamma}S_{\xi,i\Delta t}$ represents the amplitude of the component $\xi$ of the signal $^{\gamma}S$ during the $i^{th}$ time interval $\Delta t$, the characteristic of the filters $F_1$.1 to $F_1$.3 is to deliver, for any l, an output signal such that:

$$^{\gamma}S_{\xi,(15.5l)\Delta t} = \frac{1}{16,82} \cdot \sum_{k=0}^{15} a_k \, [^{\gamma}S_{\xi o,[(15.5)(l-1)+k]\Delta t} + {}^{\gamma}S_{\xi o,[(15.5)(l+1)-k]\Delta t}] \text{ with } a_k = 0.54 - 0.46 \cos \frac{2k\pi}{31}$$

The characteristic of these filters $F_1$ is shown in FIG. 4 in which the frequency is represented on the x-axis and the attenuation on the y-axis in the case where the value of each component of the signal $^{\gamma}S$ of the accelerometer is sampled every 8.3 milliseconds ($\Delta t=8.3$ ms). New filtered components thus appear every 15.5 $\Delta t$, or about every 1/7.5 seconds. The role of the filters $F_1$ is to attenuate very substantially, in the filtered components, the signal variations exhibiting a frequency higher than the maximum possible frequency of the rotation movement of the tool around its axis. It is seen in FIG. 4 that frequencies higher than 2.5 Hz undergo an attenuation greater than 3 dB.

As the appearance of the filter component $^{\gamma}S_{\xi,15.5l\Delta t}$ presupposes the former appearance of the nonfiltered component $^{\gamma}S_{\xi o,(15.5)(l+1)\Delta t}$, the output signal of the filter $F_1$ shows a certain delay in relation to the input signal. Since, obviously, all the components of the signals from the accelerometer and the magnetometer relative to the same instantaneous depth of the sonde in the well should be used, the components ${}^{\mu}S_x$, ${}^{\mu}S_y$, ${}^{\mu}S_z$, ${}^{\mu}S_{xy}$ and the norm ${}^{\mu}S_{xyz}$ of the reference signal coming from the magnetometer undergo, in the cells $R_1.1$ to $R_1.5$, a delay equivalent to that produced by the filter $F_1$ on the components of the acceleration signal.

The divider DV, to which are then applied the components ${}^{\mu}S_z$ and ${}^{\mu}S_{xy}$, carries out the ratio ${}^{\mu}S_{xy}/{}^{\mu}S_z$ which represents the tangent of the angle $\alpha$ formed between the direction of the vector of the earth's magnetic field and that of the tool axis. The information ${}^{\mu}S_{xy}/{}^{\mu}S_z$ is ther. applied to the comparator COMP 1 which compares it with a limit of a predetermined value $L_1$. If the quantity $u=({}^{\mu}S_{xy}/{}^{\mu}S_z)-L_1$ is positive or zero, the output of the comparator COMP 1 goes over to the state $T_1=0$ (general case) and, if u is negative, to the state $T_1=1$ (special case, the least frequent), $T_1$ being for example defined by the explicit function $T_1=1-\mathrm{INT}\ 2^{u}-|u|$ where "INT" designates the function "entire part of". Thus, for the generally appropriate value of $5.10^{-2}$ for $L_1$, the output $T_1$ of the comparator COMP 1 will be deactivated if the angle $\alpha$ ($\alpha=\arctan {}^{\mu}S_{xy}/{}^{\mu}S_z$) is higher than or equal to 3° (general case).

The condition $T_1$ of the output of the comparator COMP 1 allows a switching, performed symbolically by two relays $M\overline{T}_1$ and $MT_1$. The relay $M\overline{T}_1$ closes its contacts when $\overline{T}_1=1-T_1$ is equal to 1 and the relay $MT_1$ closes its contacts when $T_1$ is equal to 1. When $T_1$ is zero (general case), i.e. when $\overline{T}_1$ is equal to 1 (FIG. 3*a*), the signal ${}^{\mu}S$ of the magnetometer is used as a stabilizing signal ${}^{a}S$ and the signal ${}^{\gamma}S$ of the accelerometer as a signal to be stabilized ${}^{p}S$, which means that the signal from the magnetometer is used to correct the signal from the accelerometer for tool rotation effects. Conversely, when $T_1$ is equal to 1 (special case), i.e. when $\overline{T}_1$ is zero, the stabilizing signal ${}^{a}S$ is the signal ${}^{\gamma}S$ from the accelerometer which is used to correct the signal ${}^{\mu}S$ from the magnetometer, constituting the signal to be stabilized ${}^{p}S$.

More concisely stated, the relays $M\overline{T}_1$ and $MT_1$ fulfill the definition:

$$\begin{cases} {}^{p}S = \overline{T}_1 \cdot {}^{\gamma}S + T_1 \cdot {}^{\mu}S \\ {}^{a}S = T_1 \cdot {}^{\gamma}S + \overline{T}_1 \cdot {}^{\mu}S \end{cases}$$

for the two values of $T_1$.

In the case $T_1=1$ (special case), the components ${}^{\gamma}S_{xo}$ and ${}^{\gamma}S_{yo}$ coming from $F_1.1$ and $F_1.2$ are combined at $N_3$ to obtain the diagonal transverse component $${}^{\gamma}S_{xy} = \sqrt{({}^{\gamma}S_{xo})^2 + ({}^{\gamma}S_{yo})^2}$$

The virtual stabilization stage ET1 consists essentially in correcting the transverse axial components of the signal to be stabilized by eliminating in these components the effects of sonde rotation by means of the diagonal and axial transverse components of the stabilizing signal in the blocks $D_1$ or $D_2$; for input components ${}^{p}S_{xo}$, ${}^{p}S_{yo}$, ${}^{a}S_y$, ${}^{a}S_{xy}$, $D_1$ and $D_2$ furnish, at the output, the new components ${}^{p}S_x$ and ${}^{p}S_y$ such that:

$${}^{p}S_x = \frac{{}^{p}S_{xo} \cdot {}^{a}S_x + {}^{p}S_{yo} \cdot {}^{a}S_y}{{}^{a}S_{xy}}$$

-continued $${}^{p}S_y = \frac{{}^{p}S_{xo} \cdot {}^{a}S_y - {}^{p}S_{yo} \cdot {}^{a}S_x}{{}^{a}S_{xy}}$$

${}^{p}S_{xo}$ and ${}^{p}S_{yo}$ come from $F_1.1$ and $F_1.2$ if $T_1=0$ (general case) and from $R_1.1$ and $R_1.2$ if $T_1=1$ (special case); ${}^{a}S_x$ and ${}^{a}S_y$ come from $R_1.1$ and $R_1.2$ if $T_1=0$ (general case) and from $F_1.1$ and $F_1.2$ if $T_1=1$ (special case); and ${}^{a}S_{xy}$ comes from $N_1$ through $R_1.4$ when $T_1=0$ (general case) and from $N_3$ when $T_1=1$ (special case). The stabilized components ${}^{p}S_x$ and ${}^{p}S_y$ are substantially those which would have been obtained if there were no rotation of the sonde around its longitudinal axis. The components ${}^{p}S_x$ and ${}^{p}S_y$ coming from blocks $D_1$ or $D_2$, the longitudinal axial component ${}^{\gamma}S_z$ of the signal from the accelerometer (defining ${}^{p}S_z$ if $T_1=0$ and ${}^{a}S_z$ if $T_1=1$) and, if $T_1=1$ (special case), the diagonal component ${}^{\gamma}S_{xy}={}^{a}S_{xy}$ of the stabilizing signal then undergo, in blocks $F_2.1$ to $F_2.7$, a low-pass filtering whose characteristic is given by:

$$S_{\xi,(31.5)\Delta t} = \frac{1}{34.1} \sum_{k=0}^{31} b_k \left[S_{\xi o,[(31.5)(l-1)+k]\Delta t} + S_{\xi o,[(31.5)(l+1)-k]\Delta t}\right] \text{ with } b_k = 0.54 - 0.46 \cos \frac{2k\pi}{63}$$

The characteristic of these filters $F_2$ is shown in FIG. 5 in which the frequency is on the x-axis and the transmitted amplitude on the y-axis in the case where the value of each component to be filtered is sampled every 1/7.5 seconds ($\Delta t=1/7.5$ s). New filtered components thus appear every 31.5 $\Delta t$, or about every 4.2 seconds.

The role of the filters $F_2$ is to eliminate, from the filtered components, the variations in amplitude exhibiting a frequency higher than the maximum frequency of the amplitude variations which are attributable to the acceleration of gravity and which derive essentially from variations in the angle formed between the vertical and the longitudinal axis of the sonde. It is seen in FIG. 5 that frequencies higher than $8.10^{-2}$ Hz undergo an attenuation greater than 3 dB and increasing very rapidly.

Since the appearance of a filtered component $S_{\xi,(31.5)/\Delta t}$ presupposes the former appearance of the nonfiltered component $S_{\xi o,(31.5)(l+1)\Delta t}$, the components at the output of the filters $F_2.1$ to $F_2.7$ undergo a delay of 31.5 $\Delta t$. To eliminate the effects of this delay, the nonfiltered components undergo equivalent delays in the buffer cells $R_2.1$ to $R_2.9$.

After low-pass filtering, the components of the signal from the accelerometer are normalized. When $T_1=0$ (general case), the components of ${}^{\gamma}S={}^{p}S$ are normalized at $N_2$ which furnishes the normalized ${}^{\gamma}S_{xyz}={}^{p}S_{xyz}$ and the diagonal normalized component ${}^{\gamma}S_{xy}={}^{p}S_{xy}$ and axial normalized components ${}^{\gamma}S_x={}^{p}S_x$, ${}^{\gamma}S_y={}^{p}S_y$ and ${}^{\gamma}S_z={}^{p}S_z$. When $T_1=1$ (special case), the components of ${}^{\gamma}S={}^{a}S$ are normalized in $N_4$ which furnishes the norm ${}^{\gamma}S_{xyz}={}^{a}S_{xyz}$ and the longitudinal normalized component ${}^{\gamma}S_z={}^{a}S_z$ and diagonal normed component ${}^{\gamma}S_{xy}={}^{a}S_{xy}$.

Furthermore, when $T_1=0$ (general case), new transverse components ${}^{\gamma}S_x={}^{p}S_x$ and ${}^{\gamma}S_y={}^{p}S_y$ of the signal from the accelerometer are obtained in $E_1$ at the output of $N_2$ using the transverse components ${}^{a}S_x={}^{\mu}S_x$, ${}^{a}S_y={}^{\mu}S_y$ and ${}^{a}S_{xy}={}^{\mu}S_{xy}$ of the reference signal coming from the magnetometer. This operation $E_1$ constitutes the inverse of the operation $D_1$ mentioned previously and has the effect of reintroducing into the components of the signal from the accelerometer the information relative to the rotation of the tool around its longitudinal axis.

If $^{\gamma}S_{xo}$ and $^{\gamma}S_{yo}$ are components of $^{\gamma}S$ at the output of $N_2$ and $^{\mu}Sx$, $^{\mu}S_y$, $^{\mu}S_{xy}$ the transverse components of $^{\mu}S$ at the output of $R_2.1$, $R_2.2$ and $R_2.4$, the new components of $^{\gamma}S$ at the output of $E_1$ are:

$$^{\gamma}S_x = \frac{^{\gamma}S_{xo} \cdot {}^{\mu}S_x + {}^{\gamma}S_{yo} \cdot {}^{\mu}S_y}{^{\mu}S_{xy}}$$

$$^{\gamma}S_y = \frac{^{\gamma}S_{xo} \cdot {}^{\mu}S_y - {}^{\gamma}S_{yo} \cdot {}^{\mu}S_x}{^{\mu}S_{xy}}$$

It should be noted here that these components $^{\gamma}S_x$ and $^{\gamma}S_y$ are not all identical or proportional to the components of the output signal of the accelerometer. If these new components $^{\gamma}S_x$ and $^{\gamma}S_y$ again contain information relative to the rotation of the tool around its longitudinal axis in relation to a reference position, they are at least rid of disturbing information coming from shocks undergone by the tool against the wall of the borehole.

The final stage ET2 in combining the components of the acceleration and reference signals leads, by different operations described below, to the determination of different parameters representative of the topographical orientation of the borehole and of the position of the sonde in the well in relation to a reference position corresponding to a setting of the tool for the rotational movements around its longitudinal axis.

The diagonal transverse components $^{\gamma}S_{xy}$ and longitudinal component $^{\gamma}S_z$ of the signal from the accelerometer, normalized at $N_2$ or at $N_4$, are combined to obtain the value of a first parameter, DEV, representing the angle $\beta$ formed between the vertical and the longitudinal axis of the sonde.

If $T_1=0$ (general case), the parameter DEV is obtained at DEV 1 which furnishes the information of the same name DEV 1, and if $T_1=1$, DEV is obtained at DEV 2, furnishing the information DEV 2. The function generators DEV 1 and DEV 2 are identical and furnish the information defined by arctan ($^{\gamma}S_{xy}/^{\gamma}S_z$).

In the case $T_1=0$ (general case), the information DEV 1 is, in the comparator COMP 2, compared with an angle L2 of a predetermined value, for example equal to 0.5°; depending on the result of this comparison, one multiplies by 0 or 1 the value of two other elements of information RB1 and AZIM 1 which will be defined later. This is, schematically, represented by the possibility, for the comparator COMP2, to control two relays $MT_2.1$ and $MT_2.2$ closed or switched to the ground. The comparator COMP 2 and the relays $MT_2.1$ and $MT_2.2$ are equivalent to a test "$T_2=0$?" in which $T_2$ is a function with the value of 1 if the angle v defined by v=DEV 1−L2 is positive or zero, and a value of zero if v is negative. The function $T_2$ can, for example, take on the explicit form $T_2=INT\ 2^{v-|v|}$ in which INT designates the function "entire part of". To define the information elements RB1 and AZIM 1 previously mentioned, it is advantageous to define two functions, H and J, of two variables N and D such that:

$$H(N,D) = \text{Arctan}\frac{N}{D} + \pi \cdot INT\,2^{-D-|D|} \text{ and}$$

-continued $$J = H + 2\pi(1 - INT\,2^{H-|H|})$$

In other words, J(N,D) is equal to arctan (N/D)+$\pi$ if D is negative, and to arctan N/D if D is positive, $2\pi$ being added if arctan N/D is negative.

The two axial transverse components of the signal to be stabilized $^{\rho}S_x$, $^{\rho}S_y$, rid of the effects of tool rotation and filtered, coming from $N_2$ when $T_1=0$ (general case) and from $F_2.6$ and $F_2.7$ when $T_1=1$, the normalized longitudinal component $^{\rho}S_z$ of this same signal coming from $N_2$ when $T_1=0$ (general case) and from $R_2.9$ when $T_1=1$, and the diagonal and longitudinal components $^{a}S_{xy}$ and $^{a}S_z$ of the stabilizing signal coming from $R_2.4$ and $R_2.3$ when $T_1=0$ (general case) and from $N_4$ when $T_1=1$, are combined to obtain the value of a second parameter, AZIM, representing the angle $\zeta$ formed between the horizontal trace of the vertical plane going through the longitudinal axis of the tool and the horizontal projection of the vector of the earth's magnetic field.

For $T_1=0$ (general case), the block AZIM 1 performs the function generating the information of the same name, AZIM 1, previously mentioned and defined by:

$$AZIM\ 1 = J(N,D) \text{ with}$$

$$N = {}^{\gamma}S_y \cdot {}^{\mu}S_{xy} \text{ and } D = {}^{\mu}S_z\,[(^{\gamma}S_x)^2 + (^{\gamma}S_y)^2] - {}^{\gamma}S_z \cdot {}^{\gamma}S_x \cdot {}^{\mu}S_{xy}$$

After the test "$T_2=0$?", the information AZIM 1 becomes AZIM 2 such that AZIM 2=$T_2$.AZIM 1.

For $T_1=1$, the block AZIM 3 performs the function generating the information AZIM 3 defined by:

$$AZIM\ 3 = J(N,D) \text{ with } N = -{}^{\mu}S_y \text{ and } D = {}^{\mu}S_z \cdot {}^{\gamma}S_{xy} - {}^{\gamma}S_z \cdot {}^{\mu}S_x$$

The parameter AZIM is thus equal to AZIM 2 if $T_1=0$ (general case) and to AZIM 3 if $T_1=1$.

The three axial components $^{\gamma}S_x$, $^{\gamma}S_y$ and $^{\gamma}S$ of the signal from the accelerometer, containing the effects of tool rotation, i.e. coming, when $T_1=0$ (general case) from $F_1$ as concerns $^{\gamma}S_x$ and $^{\gamma}S_y$ and from $N_2$ for $^{\gamma}S_z$, and, when $T_1=1$, from $R_2.5$ and $R_2.6$ as concerns $^{\gamma}S_x$ and $^{\gamma}S_y$, and from $N_4$ for $^{\gamma}S_z$, and the three axial components $^{\mu}S_x$ $^{\mu}S_y$ and $^{\mu}S_z$ of the signal from the magnetometer, also containing the effects of tool rotation, i.e. coming, when $T_1=0$ (general case) from $R_2.1$, $R_2.2$ and $R_2.3$ and, when $T_1=1$, from $R_2.7$, $R_2.8$ and $R_2.9$, are combined to obtain the value of a third parameter, AZI 1, representing the angle $\delta$ formed between the horizontal projection of the vector of the earth's magnetic field and the horizontal projection of a vector perpendicular to the longitudinal axis of the tool and joining this axis to a fixed point P of the tool distant from this same axis. This combination is done, when $T_1=0$ (general case), by AZI1.1 which furnishes the information AZI1.1 such that AZI1.1=J(N,D) with $$N = {}^{\gamma}S_y \cdot {}^{\mu}S_z - {}^{\gamma}S_z \cdot {}^{\mu}S_y \text{ and}$$

$$D = {}^{\mu}S_x\,[(^{\gamma}S_y)^2 + (^{\gamma}S_z)^2] - {}^{\gamma}S_x\,({}^{\mu}S_z \cdot {}^{\gamma}S_z + {}^{\mu}S_y \cdot {}^{\gamma}S_y 9$$

When $T_1=1$, the combination of the six axial components of the signals is achieved by AZI1.2, in the same manner, i.e. with the same expressions for N and D. The parameter AZI 1 is thus equal to AZI1.1 if $T_1=0$ and to AZI1.2 if $T_1=1$.

The two transverse axial components $^{\gamma}S_x$ and $^{\gamma}S_y$ of the signal from the accelerometer, containing the effects of tool rotation, i.e. coming from E1 when $T_1=0$ (general case) and from $R_2.5$ and $R_2.6$ when $T_1=1$, are combined respectively at RB1 and RB3 to obtain the value of a fourth parameter, RB, representing the maximum angle $\theta$, or dihedral angle, formed between a vertical plane containing the longitudinal axis of the tool and a plane containing the axis of the tool and going through the fixed point P of the tool. The information elements RB1 and RB3 are expressed by the same combination of components, namely J(N,D) with $N={}^{\gamma}S_y$ and $D=-{}^{\gamma}S_x$. After the test "$T_2=0$?", the information RB1 becomes RB2 such that $RB2=T_2.RB1$. The parameter RB is thus equal to RB2 if $T_1=0$ and RB3 if $T_1=1$.

In FIG. 3*b*, the relay with double contacts $\overline{T}_1T_1$, controlled by the comparator COMP 1, represents schematically the connection of the phase for the determination of the value of the parameters with a display operation AFF for these parameters. Thus, this relay $\overline{T}_1T_1$ makes it possible to obtain, at the end of the determination phase, the parameters DEV, AZIM, AZI1 and RB which, in an explicit form, are expressed by:

$$DEV = \overline{T}_1 \cdot DEV1 + T_1 \cdot DEV2$$

$$AZIM = \overline{T}_1 \cdot T_2\, AZIM1 + T_1 \cdot AZIM3$$

$$AZI1 = \overline{T}_1 \cdot AZI1.1 + T_1 \cdot AZI1.2$$

$$RB = \overline{T}_1 \cdot T_2 \cdot RB1 + T_1 \cdot RB3$$

It is however possible, and can even be advantageous, to determine during the final stage ET2 the value of other parameters such as Sin i, i being the angle of inclination of the vector of the earth's magnetic field. This possibility is illustrated in FIG. 3*b* (case $T_1=1$). The parameter Sin i is given by:

$$\text{Sin } i={}^{P}S_x \cdot {}^{a}S_{xy}+{}^{P}S_z \cdot {}^{a}S_z$$

Further, the display of such magnitudes as the norm $^{\mu}S_{xyz}$ of the signal from the magnetometer, and the norm $^{\mu}S_{xyz}$ of the signal from the accelerometer, after low-pass filtering, makes it possible to carry out a check on the real meaning of the values obtained from the different parameters.

As stated previously, the value of L1 should be chosen rather small, preferable lower than or equal to $5.10^{-2}$($5.10^{-2}=\tan 3°$). Indeed, as the signal $^{\gamma}S$ from the accelerometer is highly disturbed by the accelerations undergone by the tool owing to its movement, it is advantageous to restrict as much as possible the use of the signal S from the accelerometer as a stabilizing signal and hence to restrict as much as possible the case $T_1=1$.

What is claimed is:

1. Method for determining at least two direction parameters of a borehole as a function of depth, comprising the steps of:

producing an acceleration signal with three components representing a set of accelerations undergone by a tool travelling through the borehole, said components being detected along three reference axes related to this tool;

producing a reference signal with three components representing a vector of fixed direction different from the vertical, in relation with said three reference axes;

combining the components of said signals, measured at a given depth of the borehole, so as to eliminate the effects of tool movement in the components of one of said signals, constituting a signal to be stabilized, by means of the components of the other signal, constituting a stabilizing signal; and combining the resulting components with components of said signals in a manner so as to derive parameters related to the position of the tool in the borehole and therefore related to direction parameters of the borehole.

2. The method of claim 1, further comprising the step of filtering said stabilized components of said signal to be stabilized to eliminate from these components the variations in frequency which are higher than the maximum frequency of the variations attributable to the acceleration of gravity.

3. The method of claim 1, wherein said parameter determination step further comprises the step of prefiltering of the component of the acceleration signal, so as to substantially attenuate, in these components, the signal variations exhibiting a frequency higher than the highest possible frequency of the rotation movement of the tool around its longitudinal axis.

4. The method of claim 1 or 3, wherein said acceleration and reference signals include components along first and second transverse sensitive axes perpendicular to each other and to the longitudinal axis of said tool, and a third component along an axis having a direction coinciding with the axis of said tool.

5. The method of claim 1, wherein said first mentioned combining step comprises the step of determining a transverse diagonal component of the stabilizing signal from transverse axial components of this signal, and wherein the step of eliminating said movement effects is achieved by means of transverse axial and diagonal components of this same signal.

6. The method of claim 5, wherein said first mentioned combining step further comprises the steps of: determining a transverse diagonal component of the reference signal from the transverse axial components of this signal; determining from this transverse diagonal component and from the longitudinal axial component of this same reference signal the sign of the difference between a first angle formed between said fixed direction vector and the longitudinal axis of the tool, and a limit angle of a predetermined value; defining the stabilizing signals and the signals to be stabilized, respectively as the reference and acceleration signals when the sign of said differences is positive and as the acceleration and reference signals when this sign is negative; and determining a transverse diagonal component of the stabilizing signal from its transverse axial components when this stabilizing signal is defined by said acceleration signal.

7. The method of claims 5 or 6, wherein said last mentioned combining step comprises the step of determining at least one norm, a normalized longitudinal component, and a normalized transverse diagonal component of the acceleration signal.

8. The method of claims 5 or 6, wherein when the sign of the difference determined during said first mentioned combining step is positive, said last mentioned combining step comprises a step for reintroducing the effects of tool rotation by furnishing from the two stabilized transverse axial components of the acceleration signal and from the diagonal and axial transverse components of the reference signal, two transverse axial components of the acceleration signal which are not stabilized in relation to said reference position of the tool around its longitudinal axis.

9. The method of claim 8, wherein said last mentioned combining step further comprises the step of determining a direction parameter by combining two nonstabilized transverse axial components of the acceleration signal in a manner representing the dihedral angle formed between a vertical plane containing the longitudinal axis of the tool and a plane containing the axis of the tool and going through a fixed point of the tool.

10. Apparatus for determining direction parameters of a borehole comprising:

an elongated tool;

means for centering said tool within a borehole;

first means, comprised within said tool, for sensing accelerations to which said housing is subjected to during tool motion in the borehole and including gravitational acceleration;

second means, comprised within said tool, for sensing the orientation of said housing with respect to a predetermined direction; and means for processing and combining the respective outputs of said first and second sensing means in a manner such as to provide direction parameters for the position of the tool at a given depth within said borehole, which parameters are substantially free from the effects of tool motion.

11. The apparatus of claim 10 further comprising:

means for effecting movement of said tool along portions of the length of said borehole; and means for measuring the travel distances of said tool in said borehole.

12. The apparatus of claim 11 further comprising:

means for coordinating the output of said measuring means with the output of said processing and combining means.

13. Apparatus for determining direction parameters of a borehole, comprising:

an elongated tool;

means for centering said tool within a borehole;

first means, comprised within said tool, for sensing accelerations to which said housing is subjected to during tool motion in the borehole, including gravitational acceleration;

second means, comprised within said tool, for sensing the orientation of said housing with respect to a predetermined direction;

first means for combining the respective outputs of said first and second sensing means in a manner such as to provide a reduction of the tool motion effects present in the output of said first sensing means; and second means for combining the output of said second sensing means with the output of said first sensing means as reduced by said first combining means to provide direction parameters for the position of the tool at a given depth within said borehole, which parameters are substantially free from the effects of tool motion.

14. A machine implemented method of processing a well log made up of a multiplicity of acceleration components representing accelerations undergone by a device moving through a borehole in an earth formation, and a second well log made up of a multiplicity of reference components representing a nonvertical vector of fixed direction, the logs being derived as the device moves through the borehole, to generate an improved log of a directional parameter of the borehole, comprising the steps of:

selecting one of said logs for to be stabilized and the other of said logs for stabilizing said log to be stabilized;

modifying components at a selected depth level of said log to be stabilized with components at said selected depth level of said log for stabilizing to obtain stabilized components from which the effects of rotational movement of said device are substantially eliminated; and using the results of the preceding step to generate an improved tangible log of a directional parameter of the borehole.

15. A method as in claim 14 further comprising, preceding said modifying step, the step of filtering acceleration components at a selected depth level of said acceleration log to reduce the effects of rotational movement of said device thereon.

16. A method as in claim 14 or 15 wherein said modifying step comprises the step of correcting transverse axial components at said selected depth level of said log to be stabilized with transverse axial components at said selected depth level of said log for stabilizing to substantially eliminate therein the effects of rotational movement of said device.

17. A method as in claim 14 or 15 further comprising, following said modifying step, the step of filtering said stabilized components to reduce the effect thereon of acceleration of said device generally attributable to nongravitational effects.

18. A method as in claim 15 further comprising, following said modifying step, the steps of:

filtering said stabilized components to reduce the effect thereon of acceleration of said device generally attributable to nongravitational effects; and following the preceding step, the step of modifying said stabilized components with the components at a selected depth level of said log for stabilizing to obtain components having reintroduced therein the effects of rotational movement of said device.

19. A machine implemented method of processing an acceleration log made up of a multiplicity of acceleration components representing accelerations undergone by a device moving through a borehole in an earth formation, and a reference log made up of a multiplicity of reference components representing a nonvertical vector of fixed direction, the logs being derived as the device moves through the borehole, to generate an improved log of a directional parameter of the borehole, comprising the steps of:

filtering acceleration components at a selected depth level of said acceleration log to reduce the effect of rotational movement of said device thereon;

modifying transverse axial acceleration components at said selected depth level of said acceleration log with transverse axial reference components and a diagonal reference component at said selected depth level of said reference log to obtain stabilized transverse axial acceleration components from which the effects of rotational movement of said device are substantially eliminated;

filtering said rotationally-stabilized transverse axial acceleration components and a longitudinal axial acceleration component at said selected depth level of said acceleration log to reduce the effect of acceleration of said device generally attributable to nongravitational effects; and using the results of the preceding step to generate an improved tangible log of a directional parameter of the borehole.

20. A method as in claim 19 wherein said using step comprises the steps of:

combining said rotationally-stabilized transverse axial acceleration components and said filtered longitudinal axial acceleration component to generate an improved tangible log of device deviation from vertical; and combining said rotationally-stabilized transverse axial acceleration components, said longitudinal axial acceleration component, said diagonal reference component, and a longitudinal axial reference component at said selected depth level of said reference log to generate an improved tangible log of device azimuth.

21. A method as in claim 19 further comprising, following said step of filtering to reduce the effect of acceleration of said device generally attributable to nongravitational effects, the step of modifying said stabilized transverse axial acceleration components with said transverse axial reference components and said diagonal reference component to obtain shock-stabilized transverse axial acceleration components having reintroduce therein the effects of rotational movement of said device.

22. A method as in claim 21 wherein said using step comprises the step of combining said shock-stabilized transverse axial acceleration components to generate an improved tangible log of dihedral angle.

* * * * *

UNITED STATES PATENT AND TRADEMARK OFFICE

CERTIFICATE OF CORRECTION

PATENT NO. : 4,362,054

DATED : December 7, 1982

INVENTOR(S) : Jean Ringot

It is certified that error appears in the above-identified patent and that said Letters Patent is hereby corrected as shown below:

In the Drawings, Figure 3a, "K2" should read -- N2 --; "AZL1.1" should read -- AZ11.1 --. Figure 3b, "$T_1T_1$" should read --$\bar{T}_1T_1$--.

In the Speciication, column 6, line 39, "1" should read -- ℓ --; line 42, "1" should read -- ℓ --. Column 7, line 24, " $^{\mu}S_{xy}$ / $^{\mu}S_z$ " should read -- $^{\mu}S_{xy}$ / $^{\mu}S_z$ --; Column 10, line 42, " $\gamma S_x$, $\gamma S_y$ and $\gamma^S$ " should read -- $^{\gamma}S_x$, $^{\gamma}S_y$ and $^{\gamma}S_z$ --; line 45, " $\gamma S_x$, $\gamma S_y$ and $\gamma^S$ " should read -- $^{\gamma}S_x$, $^{\gamma}S_y$ and $^{\gamma}S_z$ --; line 47, " $\gamma S_x$, $\gamma S_y$ and $\gamma^S$ " should read -- $^{\gamma}S_x$, $^{\gamma}S_y$ and $^{\gamma}S_z$ --; line 64, the term " $^{\mu}S_y \cdot {}^{\gamma}S_y9$ " should read -- $^{\mu}S_y \cdot {}^{\gamma}S_y)$ --.

Signed and Sealed this

Sixth Day of December 1983

[SEAL]

Attest:

GERALD J. MOSSINGHOFF

Attesting Officer

Commissioner of Patents and Trademarks